US005343946A

United States Patent [19]

Morrill

[11] Patent Number: 5,343,946

[45] Date of Patent: Sep. 6, 1994

[54] HIGH PRESSURE PACKER FOR A DROP-IN CHECK VALVE

[75] Inventor: Charles D. Morrill, Humble, Tex.

[73] Assignee: Hydril Company, Houston, Tex.

[21] Appl. No.: 104,332

[22] Filed: Aug. 9, 1993

[51] Int. Cl.[5] ..... F21B 33/12

[52] U.S. Cl. ..... 155/148; 166/165; 166/196; 166/325

[58] Field of Search ..... 166/148, 385, 386, 142, 166/264, 65.1, 165, 196, 325

[56] References Cited

U.S. PATENT DOCUMENTS

| | | | |
|---|---|---|---|
| 4,258,926 | 3/1981 | Upton | 166/196 X |
| 4,372,390 | 2/1983 | Baugh et al. | 166/148 X |
| 4,399,871 | 8/1983 | Adkins et al. | 166/325 |
| 4,450,914 | 5/1984 | Elphick | 166/325 |
| 4,745,972 | 5/1988 | Bell et al. | 166/196 X |
| 5,058,671 | 10/1991 | Cochran | 166/148 |
| 5,103,904 | 4/1992 | Luke et al. | 166/196 X |

OTHER PUBLICATIONS

Hydril Drill Stem Valves, Catalog 9106, dated 1991, pp. 13–19.

*Primary Examiner*—Thuy M. Bui
*Assistant Examiner*—Frank S. Tsay
*Attorney, Agent, or Firm*—Vaden, Eickenroht, Thompson, Boulware & Feather

[57] ABSTRACT

A packer assembly for a drop-in check valve includes a series of stacked rings in the annulus between the housing of the drop-in check valve assembly and the surface of the bore of the landing sub. The rings include at least two elastomer rings of different hardness. The top elastomer ring is capped off by a multi-part metal ring assembly comprising oppositely facing inner and outer L-shaped rings and a central T-shaped ring. The inner and outer rings have their vertical legs vertically located against the respective adjoining annulus walls and their horizontal legs in line. The trunk of the T-shaped ring is in the gap between the horizontal legs and in contact therewith so that when the elastomer ring radially expands, the metal of the metal rings is maintained in metal-to-metal contact across the annulus. This seals the annulus and prevents extrusion by eliminating all gaps. The lower elastomer ring can likewise be capped by a similar three-part metal ring assembly. An additional horizontal surface ring is located below the multi-part ring to even the upward pressure. A coil spring or an expansion band can also be used as an anti-extrusion ring with respect to the bottom surface of the lower elastomer ring.

23 Claims, 2 Drawing Sheets

HIGH PRESSURE PACKER FOR A DROP-IN CHECK VALVE

BACKGROUND OF THE INVENTION

1. Field of the Invention

This invention pertains to packers employed in sealing off a drill string so that control of the well can be reestablished after the development of a downhole high pressure condition and more specifically to the packers employed with a drop-in check valve installed in a drill string.

2. Description of the Prior Art

Circulating fluids in an oil or gas well being drilled often provide an indication of whether there is a gas build-up that may result in the creation of a hazardous condition unless precautionary steps are taken. For example, when more fluid is returned to the surface over a given time than is being used in circulation, this can be an indication that there is developing a gas build-up downhole. When this occurs, it is desirable to change the circulating fluid to a heavier composition, which heavier fluid will hold back the gas pressure formation and therefore, "reestablish" or gain control of the well.

It is not possible to make the transition from regular fluid to heavy fluid instantaneously. Unless the fluid is changed quickly, however, there is no assurance that the heavy fluid will be in use soon enough to regain control of the well. Thus, it is desirable to shut off circulation of the fluid and block off the downhole well pressure while the well is reestablished. The device that is employed downhole in the drill string for this purpose is referred to as a drop-in check valve. The deeper the well, the better and more secure this drop-in check valve has to be.

To permit the use of a drop-in check valve, a landing sub is used in the place of or in combination with a regular joint of drill pipe at a location not too far from the bottom of a hole. Such a landing sub has a central bore or opening with approximately the same inside diameter as the inside diameter of the bores of other pipe joints in the drill string. However, the inside diameter is configured with an appropriate landing shoulder to capture a freely falling drop-in check valve subassembly. Such a subassembly is used to block off the well when the conditions are as described above or at a propitious time, i.e., hopefully, during pressure build-up, but before any blowout.

A telescoping slip on the top of the subassembly with laterally outwardly biased fingers is located around the tubular central body of the subassembly. These fingers release or lock within a locking recess beneath an inside, downwardly facing shoulder in the landing sub bore so that a pressure from downhole cannot move the sub upward beyond a predetermined position. The drop-in check valve is forced down in place against the downhole pressure using a pressure hose connected to the kelly, even though the assembly itself is not held in any manner and is free to fall.

The lower end of the drop-in check valve includes a ball valve assembly having three main parts, namely, an upper housing with a valve seat in its lower end, an upwardly biased ball for seating in the valve seat when there is a high pressure downhole condition, and a ball cage for holding the bias spring and ball. When the ball is pushed upwardly, the ball housing moves up and pushes the main body of the drop-in valve assembly up to seat a sloping body surface on substantially identically slanted inside surfaces of the slip fingers. It will be recalled that the slip fingers are locked in place against upward movement.

The lower end of the body surrounds the housing of the ball valve assembly, its cross-section depending into the annulus between the housing and the bore of the landing sub. Immediately below the body in the annulus is a packer or packer assembly and immediately below the packer assembly is the top end of the ball cage, which surrounds the lower end of the ball valve housing. Thus, upward pressure on the ball cage produces pressure on the packer or packer assembly. Upward axial pressure on the packer causes it to expand radially or laterally to the inside against the housing and to the outside against the landing sub, effectively blocking off the annulus.

A packer assembly in a drop-in check valve in the prior art included a soft elastomer ring contiguous with and below a hard elastomer ring. The top of the hard elastomer ring of this packer assembly has a truncated peak in the middle and includes sloping surfaces on either side of the central peak for resting on ring parts in the bottom end of the main body, at least one of which also moved slightly outwardly to contact the inside of the bore of the landing sub when placed under pressure by the expanding hard elastomer ring. Thus, the elastomer rings are blocked against longitudinal movement and pressed laterally outwardly to retain the pressure in the annulus between the check valve housing and the landing sub. Thus, with the ball of the check valve blocking the central bore, the entire drill string is blocked off.

Although the packer assembly just described proves satisfactory in environments where the pressure is less than about 10,000 psi and the temperature is less the 250° F., pressures or pressures and temperatures above these levels can cause failure of the elastomers. Elastomers become soft under high pressure and temperature conditions and tend to extrude. When this occurs, it occurs with respect to the gap opposite the peak of the hard elastomer ring. The gap along the bore wall next to the movable piece above the hard elastomer ring and the gap below the soft elastomer ring along the bore wall and the top of the ball cage also allow possible extrusion of the respective rings to occur.

Therefore, it is a feature of the present invention to provide an improved packer, and especially an improved packer assembly in a drop-in check valve assembly, that includes a metal ring above and/or below the elastomer rings of the packer to minimize gap possibilities for the extrusion of the elastomers.

It is another feature of the present invention to provide an improved packer as noted above having expansible, overlapping metallic components that cap the top elastomer ring and forms a resulting metal-to-metal seal to prevent elastomer extrusion even under pressures up to 15,000 psi and temperatures up to 400° F.

It is still another feature of the present invention to provide an improved packer as noted above including a bottom metallic ring for limiting the amount of extrusion flowing toward the downhole high pressure in the annulus between the lower part of the drop-in valve assembly and the bore of a landing sub affixed in the drill string.

It is yet another feature of the present invention to provide an improved packer as noted above having expansible, overlapping metallic components that cap the lower elastomer ring of the packer assembly in a similar manner to the capping of the upper elastomer ring.

SUMMARY OF THE INVENTION

The drop-in check valve assembly in a preferred embodiment of the invention includes a landing sub that is included in a joint in the drill string near its lower end and a drop-in check valve subassembly for mating with the landing sub. The subassembly includes telescoping parts moving in the annulus between the subassembly and the landing sub. A packer assembly around the subassembly, and thus in the annulus, is compressed to seal off the annulus when the downhole pressure in the annulus exceeds the uphole annulus pressure. The packer includes at least one soft elastomer ring and one hard elastomer ring. Radially sliding of overlapping metal parts at the top end of the packer assembly laterally deflects or expands the metal surfaces when the elastomers are vertically compressed to seal off annulus gaps since metal-to-metal sealing is maintained throughout. A preferred metal ring of overlapping parts includes facing L-shaped metal members and a T-shaped center member that fits into a central gap between the L-shaped members. Lateral expansion of the elastomers presses the vertical legs of the L-shape members radially outwardly against the landing sub and the opposing surface of the drop-in valve subassembly while maintaining an overlap between the T-shaped member and each of the respective horizontal legs of the L-shaped members.

BRIEF DESCRIPTION OF THE DRAWINGS

So that the manner in which the above-recited features, advantages and objects of the invention, as well as others which will become apparent, are attained and can be understood in detail, more particular description of the invention briefly summarized above may be had by reference to the embodiment thereof which is illustrated in the appended drawings, which drawings form a part of this specification. It is to be noted, however, that the drawings illustrate only preferred embodiments of the invention and are therefore not to be considered limiting of its scope as the invention may admit to other equally effective embodiments.

Figure 1:
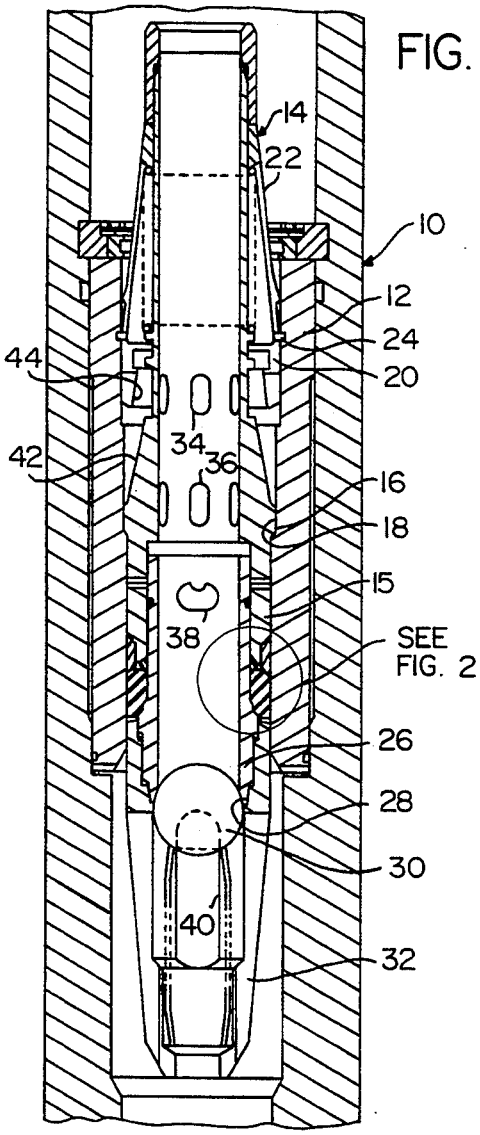

IN THE DRAWINGS:

FIG. 1 is a longitudinal cross section of a part of the drill string that includes a landing sub and a drop-in check valve subassembly for accommodating a high pressure packer in accordance with the present invention.

Figure 2:
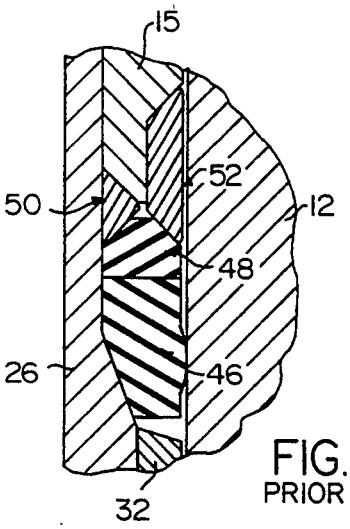
FIG. 2 PRIOR ART

FIG. 2 is a close-up cross-sectional view of prior art packer employed in the drop-in check valve assembly shown in FIG. 1.

Figure 3:
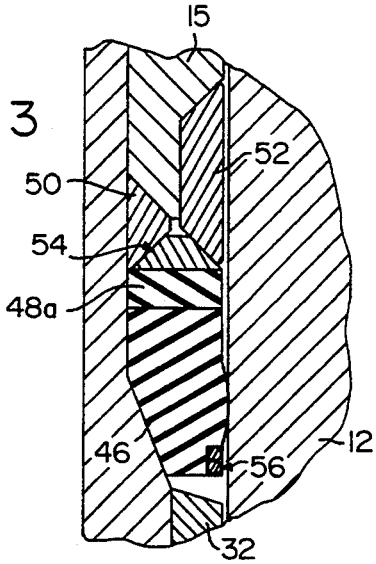

FIG. 3 is a close-up cross-sectional view of a first embodiment of a packer in accordance with the present invention employed in the drop-in check valve assembly shown in FIG. 1.

Figure 4:
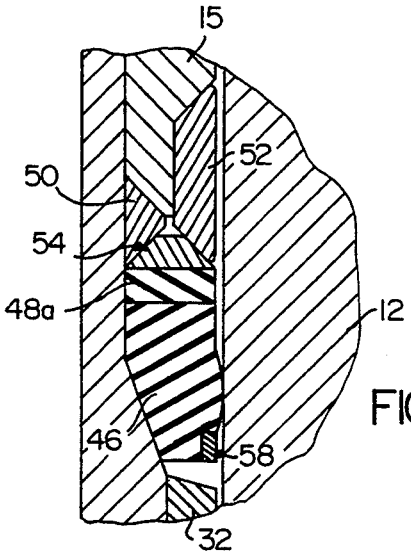

FIG. 4 is a close up cross-sectional view of a second embodiment of a packer in accordance with the present invention employed in the drop-in check valve assembly shown in FIG. 1.

Figure 5:
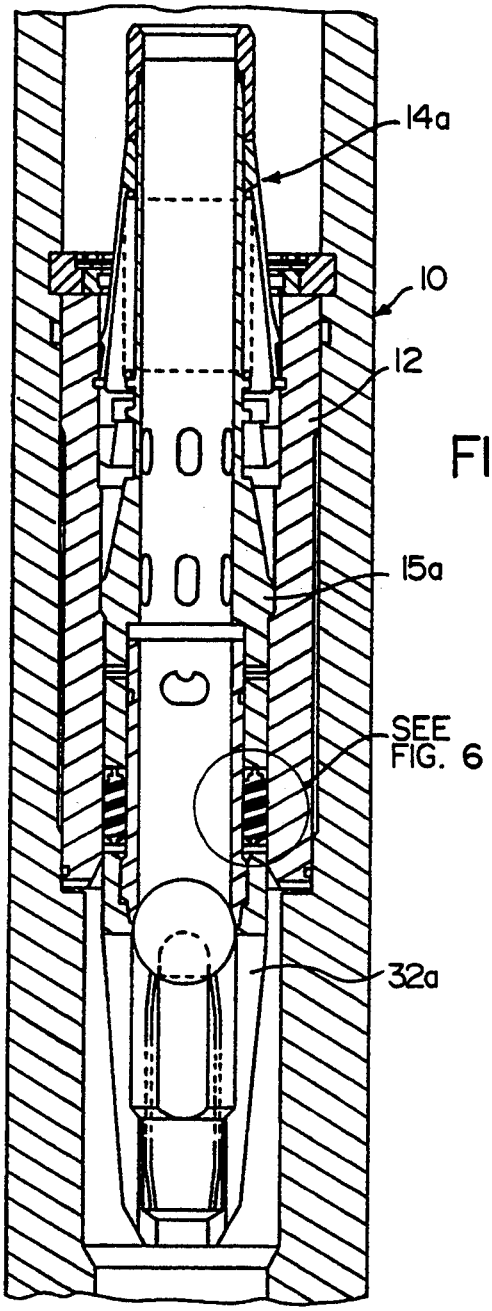

FIG. 5 is a longitudinal cross section of a part of the drill string that includes an alternative landing sub and drop-in check valve subassembly for accommodating a third embodiment of a high pressure packer in accordance with the present invention.

Figure 6:
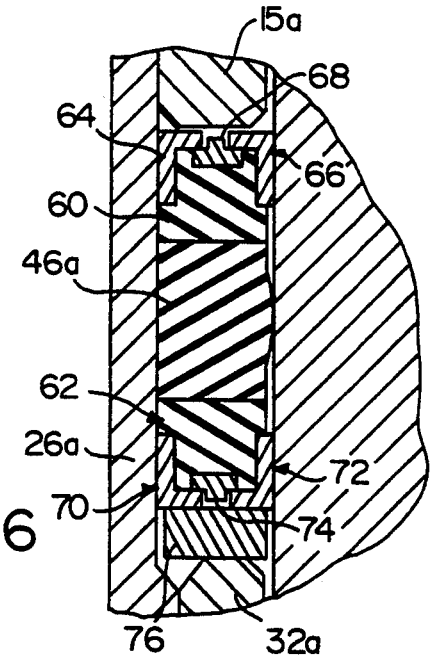

FIG. 6 is a close-up cross-sectional view of a third embodiment of the packer shown in FIG. 5.

DESCRIPTION OF THE PREFERRED EMBODIMENTS

Now referring to the drawings, and first to FIG. 1, a vertical cross section of a portion 10 of a drill string is shown that includes a landing sub 12 and a drop-in check valve assembly 14. At the time that the drill string is assembled during drilling operations, a joint 10 incorporating the landing sub is installed in the string so that this sub is not too distant from the drill bit. The drill string is assembled in this manner in anticipation that flow of the well can be shut off at the location of the landing sub in the appropriate circumstances. A typical scenario of such a circumstance is set forth in the background section discussed above.

With landing sub 12 in place in the drill string as shown, drop-in check valve assembly 14 is pressured downward in place to the position shown in FIG. 1 by pressure applied from a hose connected to the kelly (not shown). The pressure applied must be sufficient to overcome the existing downhole pressure below the landing sub. Body 15 of the drop-in check valve subassembly includes a large diameter shoulder 16 that comes to rest on inward landing shoulder 18 in the inside bore of the landing sub.

Slip fingers 20 depending from slip 22 are biased radially outwardly so that when the end of fingers 20 are located below an upwardly facing, locking shoulder 24 in the central bore of the landing sub, fingers 20 extend underneath shoulder 24 so that slip 22 is locked in a location above which it cannot rise unless a fishing tool is used to release it.

The inside bore of body 15 holds a valve seat housing 26 with a valve seat 28 at its lower end for receiving an upwardly biased ball 30. A spring in valve cage 32 establishes the upward biasing force on ball 28, the upper end of cage 32 surrounding the lower end of housing 26. Thus, it may be seen that the lower end of body 15 and the upper end of cage 32 are both located in the annulus between the housing of the valve seat and the inside bore of the landing sub. Located therebetween is the packer assembly. Details of three alternative embodiments of the packer assembly are shown in FIGS. 2, 3 and 4.

When there is fluid circulation in the well, fluid flows through the top of the central bore in the drop-in check valve and through side ports 34, 36 and 38 in the body and valve seat housing, all of which are above the packer assembly, and through elongated side port 40 in ball cage 32. Fluid circulation is permitted through the drop-in check valve as long as ball 30 is not seated in valve seat 28, or when the uphole pressure in the drill string exceeds the down hole pressure and bias spring pressure on ball 30. Such spring pressure is relatively small with respect to downhole pressure, so generally speaking the valve is not closed until the downhole pressure exceeds the uphole pressure. When this occurs, ball 30 is positioned as shown in FIG. 1.

When the downhole pressure below the drop-in check valve assembly exceeds a predetermined value above the uphole pressure, ball 30 is seated as shown, thereby blocking off fluid flow through port 40. Continued upward pressure on ball 30 causes ball 30 to push valve seat housing 26 upwardly and to carry body 12 upwardly therewith. Slanted shoulders 42 on body 12 eventually engage complementary slanted shoulders 44 on the inside of slip fingers 20, firmly securing body 12 in place. Once body 12 is constrained against further upward movement, valve seat housing moves slightly upward with respect to body 12, thereby applying longitudinal pressure on the packer assembly surrounding the valve seat housing and located between body 12 and cage 32 in the annulus between the housing and the bore of the landing sub.

Now referring to FIG. 2, a packer assembly in accordance with a prior art construction is shown. A soft elastomer ring 46 is located below and contiguous with hard elastomer ring 48. Typically the soft elastomer has a Durometer reading of 65 and the hard elastomer has a Durometer reading of 80–85. An inner anti-extrusion metal ring 50 is located at the bottom of body 15 and has slanted or tapered surfaces both with respect to body 15 and the slanted peak top surface of elastomer ring 48. Ring 50 has a vertical surface next to housing 26. Outer anti-extrusion ring 52 has similar slanted surfaces with respect to body 15 and elastomer ring 48. Its vertical surface is in alignment with the bore surface of landing sub 12. Thus, when vertical or upward longitudinal pressure is applied, the elastomers expand radially outwardly and cause the anti-extrusion rings to seal off to the inside and outside. Such sealing in an environment where the pressure does not exceed 10,000 psi or the temperature 250° has been satisfactory. However, above this pressure limit the elastomer is sufficiently plastic or soft, especially when the temperature is also above the temperature limit mentioned, that the truncated top of ring 48 tends to extrude upwardly into the gap between rings 50 and 52 and soft elastomer ring 46 tends to extrude downwardly, even against the predominant fluid pressure, in the gap between cage 32 and landing sub 12.

Now referring to FIGS. 3 and 4, two alternate embodiments of the packer assembly are shown in FIGS. 3 and 4, each of which can be employed with the drop-in check valve assembly shown in FIG. 1. In FIG. 3, it may be seen that the bottom of body 15, including inner anti-extrusion ring 50 and outer anti-extrusion ring 52, is shown. Also, the top of cage 32 is also shown. The differences lie in the fact that hard elastomer ring **48*a* is flat across its top and an additional part, namely metal ring 54, is shown with a slanted truncated cross-sectional top, the slanted sides thereof being contiguous with the slanted sides of rings 50 and 52, respectively. Metal ring 54 together with metal rings 50 and 52 provide an overlapping arrangement across the top of hard elastomer ring 48*a*** so as to prevent upward extrusion therepast.

At the lower outer edge of soft elastomer ring 46, the vertical surface of ball housing 26 is slanted inwardly to reduce the dimension of the bottom of ring 46. A coil spring 56 is employed on the lower outside edge of ring 46. This coil spring is at least overlapping by being more than 360° around, preferably on the order of 400° in circumference, so that when the elastomer ring expands laterally outwardly and stretches the coil spring somewhat, it is still overlapping at its ends. The coil spring effectively retards the downward extrusion against the upward high pressures that are applied to the lower side of soft elastomer ring 46.

The embodiment of FIG. 4 is identical to the embodiment of FIG. 3 except that expansion band or ring 58 is a single metallic band that stretches somewhat, rather than being a coil spring 56, such as shown in FIG. 3. Band 58 functions to impede extrusion in much the same manner as spring 56, however.

Now referring to FIGS. 5 and 6, a preferred embodiment of the invention is shown. The parts of landing sub 12 in FIG. 5 are substantially identical to the parts of landing sub 12 shown in FIG. 1. The majority of the parts of drop-in check valve assembly **14*a* are identical to the parts of assembly 14; however, there are some notable differences as hereinafter described. Most apparent, is that the bottom of body 15*a* is generally flat, with slight bevels at either side and there are no metal rings 50 and 52 with slanted surfaces associated with the bottom of body 15*a*. In a similar fashion, the vertical surface of housing 26*a* is not slanted next to soft elastomer ring 46*a* so that its lower end is not reduced. The upper end of cage 32*a* is slightly different from the upper end of cage 32; however, it is important to note that the end of cage 32*a*** is not horizontal across the annulus.

The main differences between the embodiment of FIGS. 5–6 and those of FIGS. 3 and 4 is in the makeup of the packer assembly, although the elastomer materials of the packer assembly of FIGS. 5–6 are substantially identical to the materials described by FIGS. 3 and 4. In FIG. 6, a soft elastomer ring **46*a* is employed in the middle of the assembly surrounded on its top side by hard elastomer ring 60 and on its bottom side by hard elastomer ring 62. The top of ring 60 is, in turn, capped by a three-piece metal ring comprised of an inverted inner L-shaped ring 64, an inverted outer L-shaped ring 66, and an inverted T-shaped ring 68. The two L-shaped rings face each other so that each has a vertical leg on the outside of ring 60, respectively, between the hard elastomer ring and the adjacent annulus walls. The respective horizontal legs are radially in line, leaving a gap therebetween for receiving therein the upward trunk of T-shaped ring 68. The top of ring 68 is horizontal and overlaps the respective horizontal legs of rings 64 and 66. The trunk length of ring 68 is slightly less than the leg width of the legs of rings 64 and 66**.

Thus, it may be seen that when hard elastomer ring expands radially carrying rings 64 and 66 apart therewith, metal-to-metal contact is maintained across the top between the horizontal legs of rings 64 and 66 and the top of ring 68. This effectively seals off any possibility of upward extrusion either at the center gap or at the sides where there is a substantial metal-to-metal contact between ring 64 and the surface of housing **26*a* and between ring 68 and the surface of landing sub 12**.

In like fashion, lower hard elastomer ring 62 is capped by a three-piece metal ring construction comprising inner L-shaped ring 70, outer L-shaped ring 72, and central T-shaped ring 74. Operation of the lower cap is substantially identical with preventing elastomer ring 62 from extruding as the upper cap is with upper elastomer ring 60, just described. However, in the case of the lower cap, there is an adjacent metal ring 76 between the top of cage **32*a* and metal rings 70, 72 and 74** that has a flat top surface for maintaining constant upward uniform pressure across the annulus. The structure just described has been successfully tested for constraining high pressures up to 15,000 psi. It also works satisfactorily even up to 450° F.

While several preferred embodiments of the invention have been described and illustrated, it will be understood that the invention is not limited thereto, or even with respect to a drop-in check valve assembly packer. Many modifications may be made and will become apparent to those skilled in the art.

What is claimed is:

1. A drop-in check valve assembly for sealing off a drill string for controlling downhole high pressures, comprising a landing sub with a central bore included as a joint in the drill string, said landing sub including a lower shoulder and an upward locking shoulder, a check valve subassembly having a body with a central bore, said check valve subassembly being constrained against downward movement by the lower shoulder of said landing sub and against upward movement by said upward locking shoulder of said landing sub, said check valve further including a ball valve housing with a ball seat at its lower end, a ball for seating with said ball seat when the downhole pressure is in excess of the uphole pressure, and a ball cage surrounding the lower end of said housing and telescoping therewith, a compressible packer assembly located about said ball valve housing, the upper surface being in contact with the lower end of said check valve subassembly body and the lower surface being in contact with the upper end of said ball cage, said compressible packer assembly including a soft elastomer ring, an adjacent hard elastomer ring above said soft elastomer ring, an upper multi-part anti-extrusion ring located above said hard elastomer ring for deflecting laterally by the movement of said hard elastomer ring when the downhole pressure exceeds the uphole pressure to seal off the gaps in the annulus between said ball valve housing and bore surface of said landing sub to prevent elastomer extrusion resulting from high downhole pressures, and an expansible lower anti-extrusion metal ring to minimize elastomer extrusion at the lower end of said packer assembly.

2. A drop-in check valve assembly in accordance with claim 1, wherein said lower anti-extrusion metal ring is a coiled spring longer than a single coil prior to pressure expansion.

3. A drop-in check valve assembly in accordance with claim 1, wherein said lower anti-extrusion metal ring is an expandable band.

4. A drop-in check valve assembly in accordance with claim 1, wherein said upper multi-part anti-extrusion ring and said lower anti-extrusion metal ring each includes an inner L-shaped ring having a vertical leg and a horizontal leg capping an inside portion of the adjacent elastomer ring, an opposing outer L-shaped ring having a vertical leg and a horizontal leg capping an outside portion of the adjacent elastomer ring, the horizontal legs of said L-shaped rings having a central gap therebetween, and a T-shaped ring having its trunk located in said central gap and its top in contact with the adjacent elastomer ring and in overlapping contact with the respective horizontal legs of said L-shaped rings, so that upon lateral expansion of said elastomer ring the inner and outer L-shaped metal rings move apart with the top of the T-shaped ring maintaining overlapping contact with the respective horizontal legs of said L-shaped rings when the vertical legs of the L-shaped rings are constrained against further lateral movement, thereby preventing extrusion of the adjacent elastomer ring by the maintenance of metal-to-metal contact of the L-shaped rings with the T-shaped ring.

5. A drop-in check valve assembly in accordance with claim 1, wherein said upper multi-part anti-extrusion ring is metal and includes an inverted inner L-shaped ring having an inside vertical leg and a horizontal leg capping an inside portion of the adjacent hard elastomer ring, an inverted opposing outer L-shaped ring having an outside vertical leg and a horizontal leg capping an outside portion of the adjacent hard elastomer ring, the horizontal legs of said inverted L-shaped rings being in-line and having a central gap therebetween, and an inverted T-shaped ring having its trunk located in the central gap of said inverted L-shaped rings and its top in contact with the adjacent hard elastomer ring and in overlapping metal-to-metal contact with the respective horizontal legs of said inverted L-shaped rings, said downhole bore pressure exceeding the uphole bore pressure by a predetermined amount exerting a vertical pressure on the hard elastomer ring to cause lateral expansion inward pressure on the vertical leg of said inner inverted L-shaped ring against the annulus wall of the ball valve housing and outward pressure on the vertical leg of said outer inverted L-shaped ring against the annulus wall of the landing sub to thereby cause lateral annulus wall pressures in excess of the downhole bore pressure.

6. A drop-in check valve assembly in accordance with claim 5 wherein anti-extrusion metal-to-metal contact between the top of said inverted T-shaped ring and the respective horizontal legs of said inverted L-shaped ring is maintained with the lateral expansion of said inner and outer inverted L-shaped rings.

7. A drop-in check valve assembly in accordance with claim 5 wherein said lower anti-extrusion metal ring includes an inner L-shaped ring having an inside vertical leg and a horizontal leg capping an inside portion of the lower elastomer of the adjacent packer assembly, an opposing outer L-shaped ring having an outside vertical leg and a horizontal leg capping an outside portion of the lower elastomer of the adjacent packer assembly, the horizontal legs of said L-shaped rings being in-line and having a central gap therebetween, a T-shaped ring having its trunk located in the central gap of said L-shaped rings and its top in contact with the lower elastomer of the adjacent packer assembly and in overlapping contact with the respective horizontal legs of said L-shaped rings, said downhole bore pressure exceeding the uphole bore pressure by a predetermined amount exerting a vertical pressure on the lower elastomer of the adjacent packer assembly to cause lateral expansion inward pressure on the vertical leg of said inner L-shaped ring against the annulus wall of the ball valve housing and outward pressure on the vertical leg of said outer L-shaped ring against the annulus wall of the landing sub to thereby cause lateral wall pressures in excess of the downhole bore pressure.

8. A drop-in check valve assembly in accordance with claim 1, wherein said upper multi-part extrusion ring is metal and includes inner and outer anti-extrusion rings each with an opposing, downwardly facing slanted side, at least one of said anti-extrusion rings being laterally expansible, and a central ring located adjacent said hard elastomer ring having a slanted truncated cross-sectional top engaging the respective slanted sides of said anti-extrusion rings and to laterally overlap therewith to prevent elastomer extrusion.

9. A drop-in check valve assembly for sealing off a drill string for controlling downhole high pressures, comprising a landing sub with a central bore included as a joint in the drill string, said landing sub including a lower shoulder and an upward locking shoulder, a check valve subassembly having a body with a central bore, said check valve subassembly being constrained against downward movement by the lower shoulder of said landing sub and against upward movement by said upward locking shoulder of said landing sub, said check valve subassembly further including a ball valve housing with a ball seat at its lower end, a ball for seating with said ball seat when the downhole pressure is in excess of the uphole pressure, and a ball cage surrounding the lower end of said housing and telescoping therewith, a compressible packer assembly located about said ball valve housing, the upper surface being in contact with the lower end of said check valve subassembly body and the lower surface being in contact with the upper end of said ball cage, said compressible packer assembly including a soft elastomer central ring portion, hard elastomer upper and lower ring portions, a laterally expansible upper metal ring for constraining said hard elastomer upper portion against pressure extrusion, and a laterally expansible lower metal ring for constraining said hard elastomer lower ring portion against pressure extrusion, said ball cage moving upward with downhole pressure in excess of uphole pressure to compress said upper and lower metal rings toward each other to cause concurrent lateral deflection expansion of said metal rings for pressure sealing the gaps in the annulus between said ball valve housing and said landing sub to prevent extrusion of said soft and hard elastomer rings as a result of high pressure and high temperature.

10. A drop-in check valve assembly in accordance with claim 9, wherein each of said upper and lower metal rings includes an inner L-shaped ring having a vertical leg and a horizontal leg capping an inside portion of the adjacent hard elastomer ring, an opposing outer L-shaped ring having a vertical leg and a horizontal leg capping an outside portion of the adjacent hard elastomer ring, the horizontal legs of said L-shaped rings having a central gap therebetween, and T-shaped ring having its trunk located in said central gap and its top in contact with the adjacent hard elastomer ring and in overlapping contact with the respective horizontal legs of said L-shaped rings, so that upon lateral expansion of said hard elastomer ring the inner and outer L-shaped metal rings move apart with the top of the T-shaped ring maintaining overlapping contact with the respective horizontal legs of the L-shaped rings when the vertical legs of the L-shaped rings are constrained against further lateral movement, thereby preventing extrusion of the adjacent hard elastomer ring by the maintenance of metal-to-metal contact of the L-shaped rings with the T-shaped ring.

11. A drop-in check valve assembly in accordance with claim 9, wherein the length of the trunk of said T-shaped ring is less than the thickness of the horizontal legs of said L-shaped rings.

12. A drop-in check valve assembly in accordance with claim 9, wherein said upper multi-part anti-extrusion ring is metal and includes an inverted inner L-shaped ring having an inside vertical leg and a horizontal leg capping an inside portion of the adjacent hard elastomer ring, an inverted opposing outer L-shaped ring having an outside vertical leg and a horizontal leg capping an outside portion of the adjacent hard elastomer ring, the horizontal legs of said inverted L-shaped rings being in-line and having a central gap therebetween, and an inverted T-shaped ring having its trunk located in the central gap of said inverted L-shaped rings and its top in contact with the adjacent hard elastomer ring and in overlapping metal-to-metal contact with the respective horizontal legs of said inverted L-shaped rings, said downhole bore pressure exceeding the uphole bore pressure by a predetermined amount exerting a vertical pressure on the hard elastomer ring to cause lateral expansion inward pressure on the vertical leg of said inner inverted L-shaped ring against the annulus wall of the ball valve housing and outward pressure on the vertical leg of said outer inverted L-shaped ring against the annulus wall of the landing sub to thereby cause lateral annulus wall pressures in excess of the downhole bore pressure.

13. A drop-in check valve assembly in accordance with claim 12 wherein anti-extrusion metal-to-metal contact between the top of said inverted T-shaped ring and the respective horizontal legs of said inverted L-shaped ring is maintained with the lateral expansion of said inner and outer inverted L-shaped rings.

14. A drop-in check valve assembly in accordance with claim 12 wherein said lower anti-extrusion metal ring includes an inner L-shaped ring having an inside vertical leg and a horizontal leg capping an inside portion of the lower elastomer of the adjacent packer assembly, an opposing outer L-shaped ring having an outside vertical leg and a horizontal leg capping an outside portion of the lower elastomer of the adjacent packer assembly, the horizontal legs of said L-shaped rings being in-line and having a central gap therebetween, a T-shaped ring having its trunk located in the central gap of said L-shaped rings and its top in contact with the lower elastomer of the adjacent packer assembly and in overlapping contact with the respective horizontal legs of said L-shaped rings, said downhole bore pressure exceeding the uphole bore pressure by a predetermined amount exerting a vertical pressure on the lower elastomer of the adjacent packer assembly to cause lateral expansion inward pressure on the vertical leg of said inner L-shaped ring against the annulus wall of the ball valve housing and outward pressure on the vertical leg of said outer L-shaped ring against the annulus wall of the landing sub to thereby cause lateral wall pressures in excess of the downhole bore pressure.

15. A drop-in check valve assembly in accordance with claim 9, wherein said laterally expansible upper metal ring includes inner and outer anti-extrusion rings each with an opposing, downwardly facing slanted side, at least one of said anti-extrusion rings being laterally expansible, and a central ring located adjacent said hard elastomer ring having a slanted truncated cross-sectional top engaging the respective slanted sides of said anti-extrusion rings and to laterally overlap therewith to prevent elastomer extrusion.

16. A drop-in check valve assembly for sealing off a drill string for controlling downhole high pressures, comprising a landing sub with a central bore included as a joint in the drill string, said landing sub including a lower shoulder for constraining downward movement of a check valve subassembly and an upward locking shoulder for securing the landed check valve subassembly against upward movement, a check valve subassembly having a central bore therethrough, including an annular body having an external landing shelf for mating with said lower shoulder of said landing sub, a slip with spring-loaded, outwardly biased slip fingers around the upper portion of said body for locking with said locking shoulder of said landing sub, a ball seat assembly located in the lower end of said body, a spring-loaded ball for seating with said ball seat assembly when the downhole pressure exceeds the uphole pressure in the central bore of said check valve subassembly, a ball cage located below said ball for holding said ball and having flow-through side ports for allowing fluid circulation therethrough when said ball is not seated, a compressible packer assembly located about said ball seat assembly, the upper surface being in contact with the lower end of said body and the lower surface being in contact with the upper end of said ball cage, said compressible packer assembly including a soft elastomer central ring portion, hard elastomer upper and lower ring portions, a lateral expansible upper metal ring for constraining said hard elastomer upper ring portion against pressure extrusion, and a lateral expansible lower metal ring for constraining said hard elastomer lower ring portion against pressure extrusion, said body including an upward-facing holding surface and said slip fingers including downward-facing constraining surfaces, said body being moved upwardly by said ball with a downhole pressure in excess of an uphole pressure, to thereby move said upward-facing holding surface of said body into contact with the downward-facing constraining surface of said slip fingers so that said body is prevented from further upward movement, said ball cage moving upward with downhole pressure in excess of uphole pressure to compress said upper and lower metal rings toward each other to cause concurrent lateral deflection expansion of said metal rings for sealing the gaps in the annulus between said ball valve housing and said landing sub to prevent extrusion of said soft and hard elastomer rings as a result of high pressure and high temperature.

17. A drop-in check valve assembly in accordance with claim 16, wherein each of said upper and lower metal rings includes an inner L-shaped ring having a vertical leg and a horizontal leg capping an inside portion of the adjacent hard elastomer ring, an opposing outer L-shaped ring having a vertical leg and a horizontal leg capping an outside portion of the adjacent hard elastomer ring, the horizontal legs of said L-shaped rings having a central gap therebetween, and a T-shaped ring having its trunk located in said central gap and its top in contact with the adjacent hard elastomer ring and in overlapping contact with the respective horizontal legs of said L-shaped rings, so that upon lateral expansion of said hard elastomer ring the inner and outer L-shaped metal rings move apart with the top of the T-shaped ring maintaining overlapping contact with the respective horizontal legs of said L-shaped rings when the vertical legs of the L-shaped rings are constrained against further lateral movement, thereby preventing extrusion of the adjacent hard elastomer ring by the maintenance of metal-to-metal contact of the L-shaped rings with the T-shaped ring.

18. A drop-in check valve assembly in accordance with claim 17, wherein the length of the trunk of said T-shaped ring is less than the thickness of the horizontal legs of said L-shaped rings.

19. A drop-in check valve assembly in accordance with claim 18, and including an additional metal ring having a horizontal top surface for contacting the horizontal legs of both said inner and outer L-shaped metal rings and a bottom surface for contacting said ball cage so as to maintain an even upward pressure on the lower hard elastomer ring when said ball cage moves upward.

20. A drop-in check valve assembly in accordance with claim 17, wherein said upper multi-part anti-extrusion ring is metal and includes an inverted inner L-shaped ring having an inside vertical leg and a horizontal leg capping an inside portion of the adjacent hard elastomer ring, an inverted opposing outer L-shaped ring having an outside vertical leg and a horizontal leg capping an outside portion of the adjacent hard elastomer ring, the horizontal legs of said inverted L-shaped rings being in-line and having a central gap therebetween, and an inverted T-shaped ring having its trunk located in the central gap of said inverted L-shaped rings and its top in contact with the adjacent hard elastomer ring and in overlapping metal-to-metal contact with the respective horizontal legs of said inverted L-shaped rings, said downhole bore pressure exceeding the uphole bore pressure by a predetermined amount exerting a vertical pressure on the hard elastomer ring to cause lateral expansion inward pressure on the vertical leg of said inner inverted L-shaped ring against the annulus wall of the ball valve housing and outward pressure on the vertical leg of said outer inverted L-shaped ring against the annulus wall of the landing sub to thereby cause lateral annulus wall pressures in excess of the downhole bore pressure.

21. A drop-in check valve assembly in accordance with claim 20 wherein anti-extrusion metal-to-metal contact between the top of said inverted T-shaped ring and the respective horizontal legs of said inverted L-shaped ring is maintained with the lateral expansion of said inner and outer inverted L-shaped rings.

22. A drop-in check valve assembly in accordance with claim 20 wherein said lower anti-extrusion metal ring includes an inner L-shaped ring having an inside vertical leg and a horizontal leg capping an inside portion of the lower elastomer of the adjacent packer assembly, an opposing outer L-shaped ring having an outside vertical leg and a horizontal leg capping an outside portion of the lower elastomer of the adjacent packer assembly, the horizontal legs of said L-shaped rings being in-line and having a central gap therebetween, a T-shaped ring having its trunk located in the central gap of said L-shaped rings and its top in contact with the lower elastomer of the adjacent packer assembly and in overlapping contact with the respective horizontal legs of said L-shaped rings, said downhole bore pressure exceeding the uphole bore pressure by a predetermined amount exerting a vertical pressure on the lower elastomer of the adjacent packer assembly to cause lateral expansion inward pressure on the vertical leg of said inner L-shaped ring against the annulus wall of the ball valve housing and outward pressure on the vertical leg of said outer L-shaped ring against the annulus wall of the landing sub to thereby cause lateral wall pressures in excess of the downhole bore pressure.

23. A drop-in check valve assembly in accordance with claim 16, wherein said laterally expansible upper metal ring includes inner and outer anti-extrusion rings each with an opposing, downwardly facing slanted side, at least one of said anti-extrusion rings being laterally expansible, and a central ring located adjacent said hard elastomer ring having a slanted truncated cross-sectional top engaging the respective slanted sides of said anti-extrusion rings and to laterally overlap therewith to prevent elastomer extrusion.

* * * * *